US009133621B2

(12) United States Patent
Railkar et al.

(10) Patent No.: US 9,133,621 B2
(45) Date of Patent: Sep. 15, 2015

(54) SELF ADHESIVE UNIVERSAL INSIDE CORNER PATCH FOR MEMBRANE ROOFING

(71) Applicant: Building Materials Investment Corporation, Dallas, TX (US)

(72) Inventors: Sudhir B. Railkar, Wayne, NJ (US); Lynn G. Picone, Scotch Plains, NJ (US); Brian Duffy, Wayne, NJ (US); Dave Scott, Grove City, OH (US); Li-Ying Yang, Whippany, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 14/132,309

(22) Filed: Dec. 18, 2013

(65) Prior Publication Data

US 2014/0165478 A1 Jun. 19, 2014

Related U.S. Application Data

(60) Provisional application No. 61/738,618, filed on Dec. 18, 2012, provisional application No. 61/825,239, filed on May 20, 2013.

(51) Int. Cl.
*E04D 13/00* (2006.01)
*E04D 3/40* (2006.01)

(52) U.S. Cl.
CPC . *E04D 3/40* (2013.01); *E04D 13/00* (2013.01)

(58) Field of Classification Search
CPC ..... E04D 5/06; E04D 5/14; E04D 1/36; E04D 13/14; E04D 3/40; E04D 13/00; E04D 13/1346; E04D 13/1476; E04D 13/1415; E04D 5/149; E04D 5/1475
USPC ..... 52/58, 60–62, 287.1, 288.1, 631, 408, 52/411–413, 514, 514.5, 219, 302.6, 198; 428/40.1, 40.3, 41.3, 42.1, 44, 51, 119, 428/120, 63, 81, 98, 130, 131, 343, 346, 428/347
See application file for complete search history.

(56) References Cited

U.S. PATENT DOCUMENTS

| | | | | |
|---|---|---|---|---|
| 3,325,953 | A | 6/1967 | Alleaume | |
| 4,330,581 | A | 5/1982 | Borgert et al. | |
| 4,462,190 | A | 7/1984 | Allen | |
| 4,598,505 | A | 7/1986 | McGown | |
| 4,603,517 | A * | 8/1986 | Lyons, Jr. | 52/60 |
| 4,635,409 | A | 1/1987 | Vandemore | |

(Continued)

*Primary Examiner* — Beth Stephan
(74) *Attorney, Agent, or Firm* — Womble Carlyle Sandridge & Rice LLP

(57) ABSTRACT

A universal inside corner patch for patching inside corners formed by protrusions from a commercial low slope roof is disclosed. The universal inside corner patch includes a body having a central portion and a peripheral portion. A cutout is formed in the body extending from the peripheral portion to the central portion thereof. The cutout defines in the body a skirt having an edge on one side of the cutout and a flap having an edge on an opposite side of the cutout. Folding locations such as lines or other indicia on the body correspond to respective angles of an inside corner to be patched. When the skirt portion is overlapped with the flap portion with the edge of the skirt portion registering with one of the folding locations, the inside corner patch is configured to conform to an inside corner with an angle corresponding to the one of the folding locations. An adhesive may be disposed on a back surface of the body for adhering and sealing the corner patch in place.

21 Claims, 4 Drawing Sheets

(56) References Cited

U.S. PATENT DOCUMENTS

| | | | | |
|---|---|---|---|---|
| 4,781,008 | A | 11/1988 | Lyons, Jr. | |
| 4,799,986 | A | 1/1989 | Janni | |
| 4,872,296 | A | 10/1989 | Janni | |
| 4,969,250 | A | 11/1990 | Hickman et al. | |
| 5,072,552 | A | 12/1991 | Sauder | |
| 5,077,943 | A * | 1/1992 | McGady | 52/58 |
| 5,414,964 | A | 5/1995 | Bodycomb | |
| 5,581,959 | A | 12/1996 | Occhipinti | |
| 5,706,610 | A * | 1/1998 | Mayle | 52/60 |
| D400,080 | S | 10/1998 | Beard, Jr. | |
| 5,896,711 | A | 4/1999 | McClure | |
| 5,983,592 | A | 11/1999 | Mayle | |
| 6,070,370 | A * | 6/2000 | Locke | 52/58 |
| 6,122,874 | A | 9/2000 | Smerilli | |
| 6,199,326 | B1 * | 3/2001 | Mayle | 52/58 |
| 6,401,402 | B1 * | 6/2002 | Williams | 52/58 |
| 6,457,279 | B1 | 10/2002 | Jacobsen et al. | |
| 6,681,530 | B1 * | 1/2004 | Givens | 52/58 |
| 6,705,050 | B2 * | 3/2004 | Nichols, Jr. | 52/62 |
| 6,715,237 | B2 | 4/2004 | Batt, Sr. | |
| 6,754,993 | B1 | 6/2004 | Mayle et al. | |
| 6,892,782 | B1 | 5/2005 | Mayle | |
| 7,168,211 | B2 | 1/2007 | Prenn et al. | |
| 7,373,729 | B2 | 5/2008 | Mossot et al. | |
| 7,638,180 | B2 | 12/2009 | Nebesnak | |
| 8,161,688 | B2 | 4/2012 | Railkar | |
| 8,161,689 | B1 * | 4/2012 | Butzen | 52/58 |
| 2003/0150175 | A1 | 8/2003 | Rillie | |
| 2004/0074156 | A1 | 4/2004 | Haynes | |
| 2005/0055889 | A1 | 3/2005 | Thaler | |
| 2005/0166471 | A1 | 8/2005 | Allen | |
| 2005/0268561 | A1 | 12/2005 | Lane et al. | |
| 2006/0053699 | A1 | 3/2006 | Lolley et al. | |
| 2006/0130411 | A1 | 6/2006 | Edgar et al. | |
| 2006/0177617 | A1 * | 8/2006 | Nebesnak | 428/40.1 |
| 2009/0090068 | A1 | 4/2009 | O'rourke | |
| 2009/0277102 | A1 | 11/2009 | Bishop et al. | |
| 2010/0175342 | A1 * | 7/2010 | Railkar | 52/514 |
| 2012/0180402 | A1 | 7/2012 | Kalwara et al. | |
| 2012/0216474 | A1 * | 8/2012 | Railkar | 52/302.6 |

* cited by examiner

SELF ADHESIVE UNIVERSAL INSIDE CORNER PATCH FOR MEMBRANE ROOFING

REFERENCE TO RELATED APPLICATIONS

Priority is hereby claimed to the filing date of U.S. provisional patent application 61/738,618 entitled Universal Inside Corner Patch for Membrane Roofing filed on Dec. 18, 2012 and to the filing date of U.S. provisional patent application 61/825,239 entitled Self Adhesive Universal Inside Corner Patch for Membrane Roofing filed on May 20, 2013.

TECHNICAL FIELD

The invention disclosed herein relates generally to membrane roofing for low slope roofs such as those found on commercial buildings and more specifically to sealing or patching corners formed by protrusions extending upwardly from commercial roof decks when installing a membrane roof on the deck.

BACKGROUND

Polymeric membranes are commonly used to seal flat or low slope roofs of commercial buildings. Such membranes may be made of a variety of thermoplastic materials including, without limitation, Polyvinyl Chloride (PVC), PVC Alloys or Compounded Thermoplastics such as Tripolymer Alloy (TPA), Thermoplastic Olefin (TPO), Chlorinated Polyethylene (CPE), and Ethylene propylene diene terpolymer (EPDM). The most common types of commercial roofing membranes are made of PVC or TPO. The invention may be described herein for the sake of clarity primarily within the context of TPO membrane roofing. It will be understood, however, that the invention is not limited to TPO roofing membranes but applies to any other type of membrane used to roof and waterproof commercial and other buildings having low slope roofs.

When roofing a low slope roof, webs of membrane material are rolled out on a roof and adhered or bonded along their seams to provide a waterproof barrier atop the deck of the roof. Commercial roofs virtually always have protrusions that project upwardly from the roof deck. Such protrusions include, for example, HVAC ducts, ventilation ducts, rectangular protrusions for skylights and other features, parapets, and others. Non-circular protrusions such as rectangular protrusions define outside corners where the edges of the protrusion meet the roof deck. Other protrusions, such as parapets, form inside corners where two walls of the parapet meet the roof deck. Other protrusions that form inside and outside corners also may be present. In order to seal the roof, these corners must be sealed against water penetration. Traditionally, roofers would fabricate corner patches in the field by cutting, trimming, and configuring a scrap piece of membrane material until it fit a particular corner. This is a time consuming process, requires skill, and sometimes does not result in a good fitting leak proof patch.

More recently, prefabricated outside corner patches have been developed for sealing outside corners of protrusions on a commercial roof. U.S. Pat. No. 8,161,688, owned by the assignee of the present application, discloses a radially scalloped outside corner patch that, when spread out, conforms to substantially orthogonal outside corners of a protrusion. Pending U.S. patent application Ser. No. 13/454,674, also owned by the assignee of the present application, discloses a universal outside corner patch that is designed to conform to non-orthogonal outside corners of a protrusion. The disclosures of these documents are hereby incorporated by reference in their entireties. Accordingly, the convenient sealing of outside corners, both orthogonal and non-orthogonal, defined by protrusions from a commercial roof has been addressed.

Inside corners have been a different story. For orthogonal inside corners (corners formed by two inside walls that meet that meet each other and the roof deck at 90 degree angles), corner patches are available that are molded with three orthogonal sides that fit against the orthogonal sides and roof deck of an inside corner. However, inside corners often are not orthogonal and traditional inside corner patches do not fit well. When a corner patch does not fit well, it can lead to leaks at these corners over time. In cases where an inside corner includes a surface at an angle of more than a few degrees difference from 90 degrees, traditional inside corner patches cannot be used at all. A need exists for a universal inside corner patch that can conform to non-orthogonal inside corners or inside corners where one or more walls forming the corner meets the other walls or the roof deck at an angle significantly different than 90 degrees. Such a universal inside corner patch should also be equally usable just like pre-molded patches to seal orthogonal inside corners. It is to the provision of such a universal inside corner patch and to a method of sealing inside corners that the present invention is primarily directed.

SUMMARY

Briefly described, a universal inside corner patch is disclosed for sealing inside corners formed by protrusions such as parapets from a low slope commercial roof when covering and sealing the roof with membrane roofing material. Preferably, the body of the corner patch is made of the same material as a membrane used to cover the roof deck. In one embodiment, the universal inside corner patch comprises a body having a central portion and a peripheral portion. A cutout is formed in the body extending from the peripheral portion toward the central portion thereof. The cutout defines in the body a skirt portion having an edge on one side of the cutout and a flap portion on an opposite side of the cutout. Folding locations, which can be fold lines or other indicia, on the body correspond to respective angles of an inside corner to be patched.

When the skirt portion is overlapped with the flap portion with the edge of the skirt portion registering with one of the folding locations, the inside corner patch is configured to conform to an inside corner with an angle corresponding to that folding location. The folding locations may correspond to inside corners with significantly acute angles such as 70 degrees and significantly obtuse angles such as 120 degrees. A self-adhesive coating may be provided on the back surface of the body to help hold the corner patch in its folded configuration and in place on the roof. The self-adhesive coating may be covered with a peel-off protective sheet. These and other aspects, features, and advantages of the invention disclosed herein will become more apparent to the skilled artisan upon review of the detailed description set forth below taken in conjunction with the accompanying drawing figures, which are briefly described as follows.

DETAILED DESCRIPTION

Figure 1:
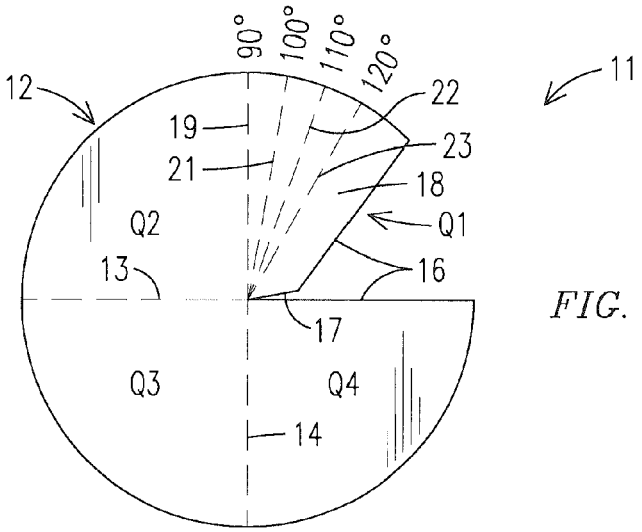
FIG. 1 is a plan view of a universal inside corner patch that embodies principles of the invention in one embodiment.

Referring now in more detail to the drawing figures, wherein like reference numerals, where appropriate, indicate like parts throughout the several views, FIG. 1 illustrates a universal inside corner patch that embodies principles of the invention in one preferred form. The corner patch 11 is cut from a piece of roofing membrane material such as TPO that preferably is the same as the material of the membrane to be used to cover a roof deck. Most preferably, the material has a flexural modulus of between 1,500 psi and 20,000 psi. In the illustrated embodiment, the patch is circular in shape, although this is not a limitation of the invention. The patch 11 comprises a body 12 that is divided by fold lines into four quadrants, Q1, 02, Q3, and Q4. In the illustrated embodiment, the quadrants are orthogonal inasmuch as the fold lines 13 and the line defined by fold lines 14 and 19 intersect one another at 90 degree angles. However, this is not a limitation of the invention and the quadrants may be other than orthogonal according to application specific needs.

Quadrant Q1 is characterized by an angular or pie-shaped cutout 16 extending from the perimeter of the body 12 toward a center portion thereof. A smaller relief cut 17 extends from the center of the body 12 radially outwardly to meet the cutout 16. The function of the relief cut 17 will be described in more detail below. The cutout 16 and the relief cut 17 together partially sever the material of quadrant Q1 from the body of the patch to form a lap or flap portion 18. Radially extending fold lines 19, 21, 22, and 23 are defined in the flap portion 18 and the fold lines correspond to folds to be made in the flap portion 18 for various angles of inside corners to be sealed with the corner patch. In the illustrated embodiment, for instance, fold line 19 corresponds to an inside corner angle to be patched of 90 degrees, fold line 21 to an angle of 100 degrees, 22 to 110 degrees, and 23 to 120 degrees.

Figure 2:
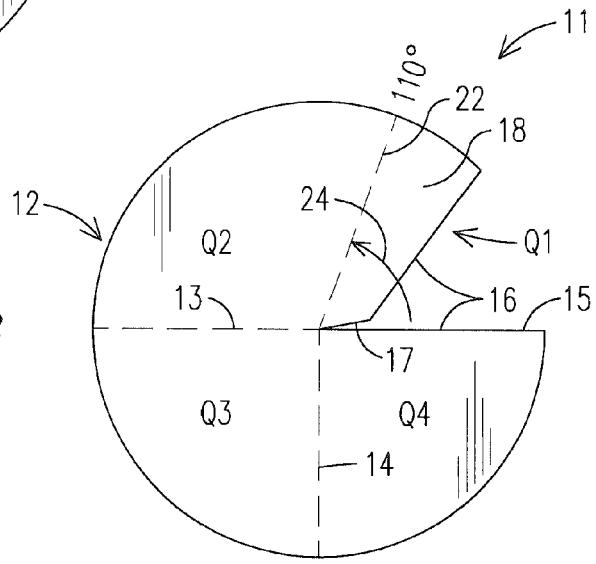
FIG. 2 is a plan view of the universal inside corner patch of FIG. 1 emphasizing a configuration for a 110 degree inside corner.
Figure 3:
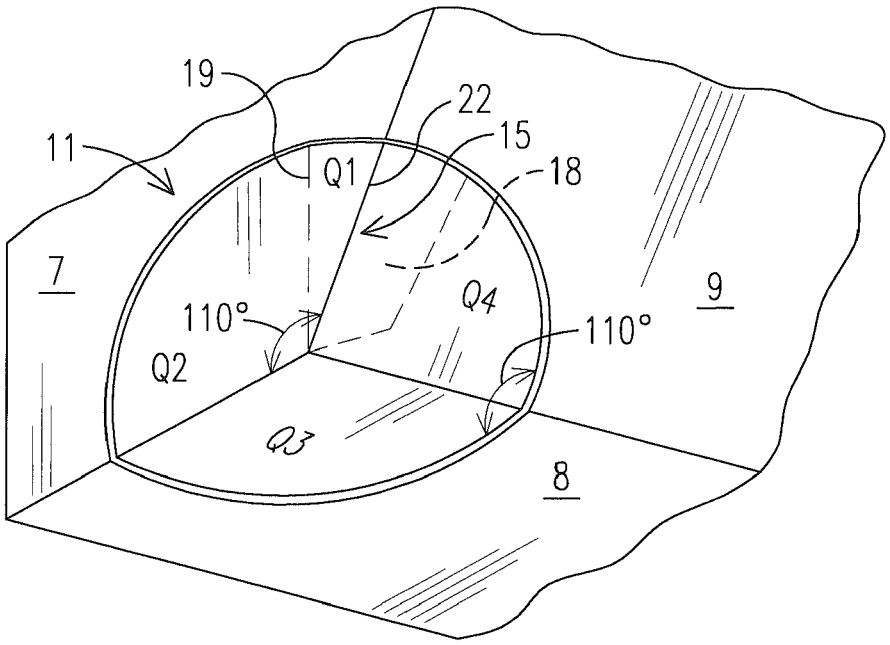
FIG. 3 is a perspective view of the corner patch of FIG. 2 folded and welded to form an inside corner patch for a 110 degree inside corner.

FIGS. 2 and 3 illustrate use of the universal inside corner patch of FIG. 1 for sealing an inside corner with one of its three walls extending upwardly from a roof deck at an obtuse angle of, in this example, 110 degrees. Referring to FIG. 2, the patch 11 is first folded along selected fold lines to form the shape of the patch. More specifically, quadrants Q2, Q3, and Q4 are folded upwardly in a direction out of the page in FIG. 2 along fold lines 13 and 14. Quadrant Q1 is folded along the 110 degree fold line 22 such that the flap portion 18 moves upwardly out of the page in FIG. 2. The edge 15 of quadrant Q4 on one side of the pie-shaped cutout 16 is moved into registration with the now folded 110 degree fold line 22 as indicated by arrow 24 in FIG. 2. The portion of quadrant Q4 that overlaps the flap portion 18 is referred to herein as the skirt portion. At this point, the shape of the corner patch is essentially formed.

The flap portion can be adhered to the back of skirt portion if desired to hold the shape of the corner patch while it is moved into a corner to be patched. Alternatively, the folded patch can simply be placed into the corner and then massaged into a good close fit before it is adhered and sealed to surrounding TPO material. In one embodiment, described in more detail below, a self adhesive coating covered by a peal-off protective sheet is provided on the back side of the corner patch. In this embodiment, the protective sheet may be peeled off before or during the folding process so that the skirt portion of quadrant Q4 self-adheres to the flap portion 18 when the patch is folded to retain the folded shape of the patch.

FIG. 3 illustrates the shape of an inside corner patch folded as described in the previous paragraph. As can be seen, the flap portion 18 is folded behind the skirt portion of quadrant Q4 with the edge 15 of the skirt portion defined by the pie-shaped cutout being registered with the 110 degree fold line 22. A portion of quadrant Q1 between the 90 degree fold line and the 110 degree fold line forms an extension of quadrant Q2 so that the total angular extent of quadrant Q2 and the extension is 110 degrees. It will thus be appreciated that quadrant Q4 forms an angle of 110 degrees with respect to quadrant Q3. At the same time, quadrant Q2 forms an angle of 90 degrees with respect to quadrant Q3. Accordingly, in this configuration, the corner patch 11 fits snuggly into an inside corner defined by the intersection of roof deck 8 with upstanding walls 7 and 9, where wall 9 extends upwardly from the roof deck 8 at an angle of 110 degrees. The corner patch can then be bonded and sealed to the surrounding membrane material in a conventional manner to seal the corner. Thus, the universal inside corner patch of this invention reliably seals an obtuse inside corner.

Figure 4:
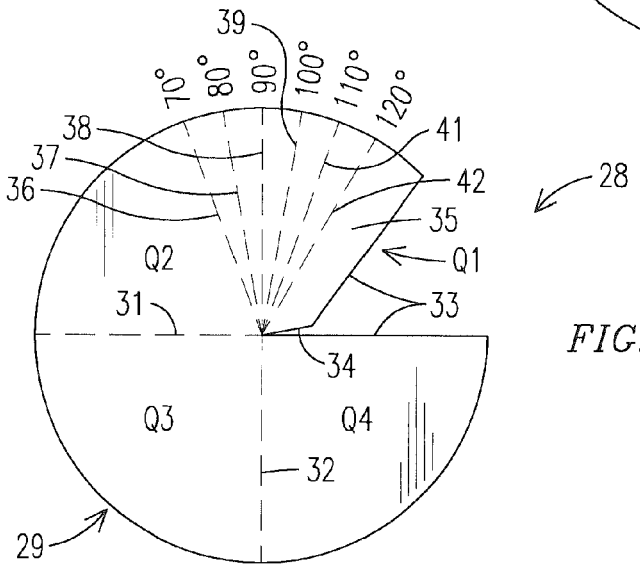
FIG. 4 is a plan view of a universal inside corner patch that embodies principles of the invention in another embodiment.

FIG. 4 illustrates a universal inside corner patch very similar to that of FIG. 1, except this inside corner patch can be folded to accommodate both acute and obtuse inside angle corners. Similar to FIG. 1, the corner patch 28 of FIG. 4 is cut from a piece of roofing membrane material such as TPO or other material that preferably is the same as that used to cover a roof deck. The patch 28 comprises a body 29 that is divided by fold lines 31 and 32 into four quadrants, Q1, Q2, Q3, and Q4. The fold lines 31 and 32 intersect one another at 90 degree angles in this embodiment.

Quadrant Q1 is characterized by an angular or pie-shaped cutout 33 extending from the perimeter of the body 28 toward a center portion thereof. A smaller relief cut 34 extends from the center of the body 12 radially outwardly to meet the cutout 33. The cutout 33 and the relief cut 34 together partially sever the material of quadrant Q1 from the body of the patch to form a lap or flap portion 36. Radially extending fold lines 36, 37, 38, 39, and 41 are defined in the flap portion 36 and these fold lines correspond to folds to be made in the flap portion 36 for various angles of inside corners, both acute and obtuse, to be sealed with the corner patch. In the illustrated embodiment, for instance, fold line 38 corresponds to an inside corner angle to be patched of 90 degrees, fold line 39 to an obtuse angle of 100 degrees, and 76 to an acute angle of 70 degrees.

Figure 5:
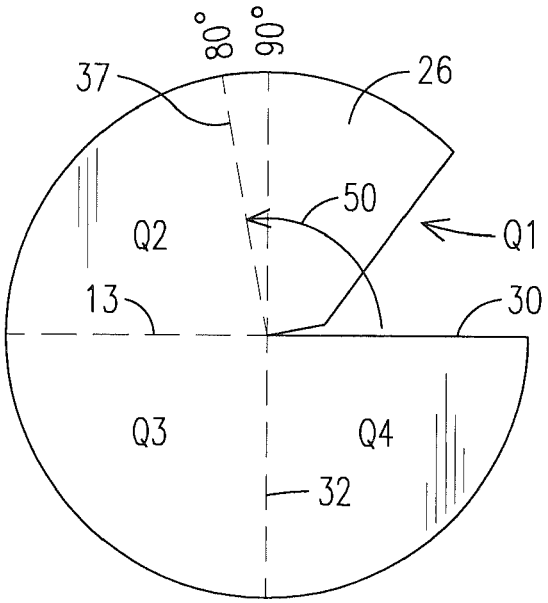
FIG. 5 is a plan view of the universal inside corner patch of FIG. 4 emphasizing a configuration for an 80 degree inside corner.
Figure 6:
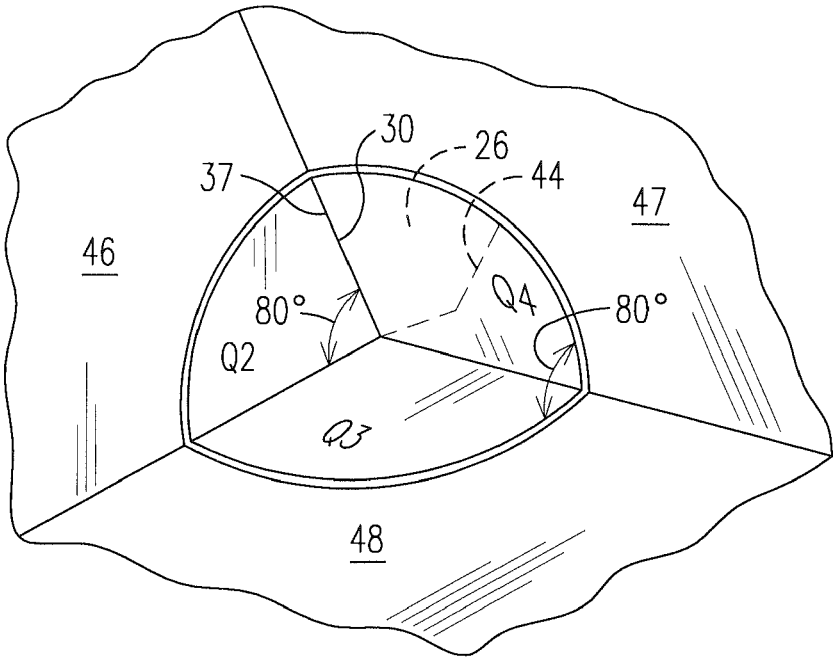
FIG. 6 is a perspective view of the universal inside corner patch of FIG. 5 folded and sealed to fit an 80 degree inside corner.

FIGS. 5 and 6 illustrate application of the universal corner patch of FIG. 4 to seal an acute inside corner having a wall that defines an angle of, in this example, 80 degrees. The process is similar to that just described in the previous paragraph for an obtuse angle. Referring to FIG. 5, the corner patch is folded along fold lines 31 and 32 in a direction out of the page in FIG. 5 until quadrant Q2 forms an angle of 90 degrees with respect to quadrant Q3 and quadrant Q3 forms an angle of 90 degrees with respect to quadrant Q4. The lap or flap portion 26 of quadrant Q1 is then folded upwardly out of the page along the 80 degree fold line 37. Skirt portion of quadrant Q4 is overlapped onto the flap portion 26 until the edge 30 comes into registration with the 80 degree fold line, as illustrated by arrow 50 in FIG. 5. The corner patch can then be tacked in this configuration if desired; or, where an adhesive backing is present, the skirt portion adheres itself to the flap portion upon contact. As shown in FIG. 6, the universal corner patch, when configured as just described, fits snuggly into an inside corner where one wall 46 forms a right angle with respect to a roof deck 48 and an adjacent wall 47 forms an acuter angle of, in this case, 80 degrees with respect to the roof deck 48. The corner patch can then be adhered to surrounding membrane material in a conventional manner, or it may self adhere where an adhesive backing is present, to seal the corner.

Figure 7:
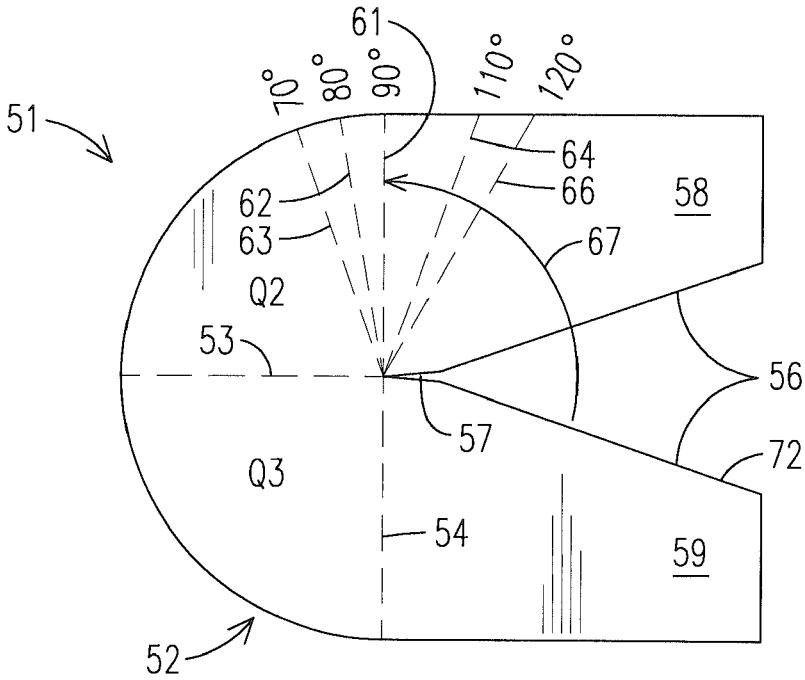
FIG. 7 is a top plan view of a universal inside corner patch configured to conform to a valley of arbitrary angle.
Figure 8:
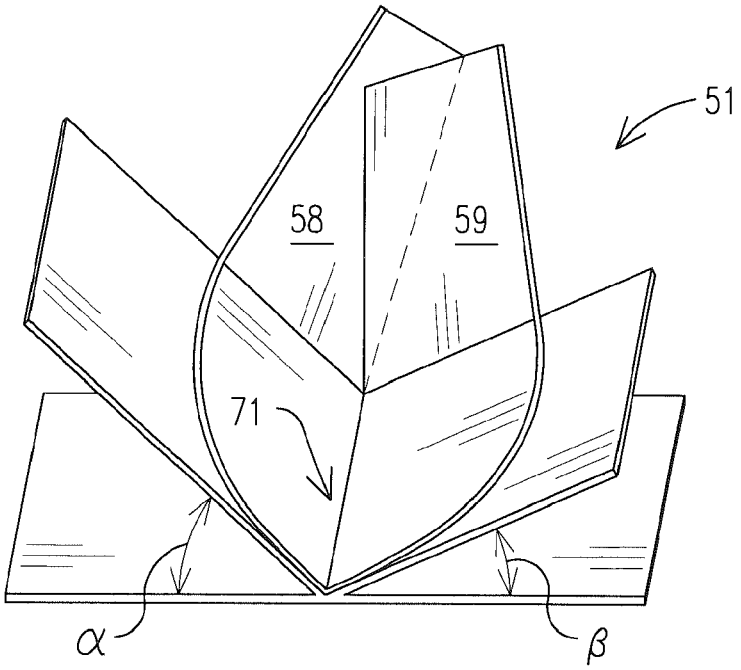
FIG. 8 is a perspective view of the universal inside corner patch of FIG. 7 folded to fit a valley.

FIGS. 7 and 8 illustrate an alternate embodiment of the invention for use to seal valley corners of various angles. In this embodiment, a patch 51 is cut from a membrane material such as TPO into a shape having a semi-circular portion to the left in FIG. 7. The right side of the patch 51 in FIG. 7 comprises a pie-shaped cutout 56 and a relief cut 57 that separate the material of the patch into a first leg 58 and a second leg 59. Fold lines 53, 54, and 61 define quadrants Q2 and Q3 in the semicircular left portion of the patch. Fold line 61 corresponds to a 90 degree fold. The patch 51 further comprises fold lines arrayed about the 90 degree fold line 61 corresponding to acute and obtuse angle folds of various degrees. In the illustrated embodiment, for example, there is shown a 70 degree fold line 63, an 80 degree fold line 62, a 110 degree fold line 64, and a 120 degree fold line 66. While specific angles are indicated in the drawing, it will be understood by the skilled artisan that other and different angles are possible within the scope of the invention.

To adapt the universal valley patch 51 for sealing a valley 71 (FIG. 8) of a particular angle, the patch 51 is folded upwardly out of the page in FIG. 7 along fold lines 53 and 54. The patch is then folded along a fold line corresponding to the angle of a valley to be sealed with the patch. In FIG. 8, for example, a valley having an angle 71 that is equal to $\alpha+\beta$ is shown. The edge 72 of the patch is folded over as shown by arrow 67 until it registers with the fold line corresponding to the valley angle, whereupon the patch can be tacked in this configuration or it may self adhere where an adhesive backing is present. The patch is then placed in the valley, where it conforms to the angle of the valley and can be adhered to surrounding membrane material to seal the valley, as illustrated in FIG. 8.

Figure 9:
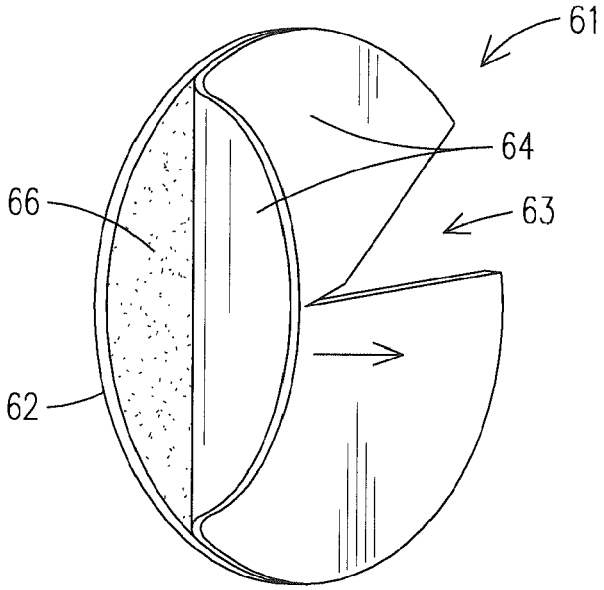
FIG. 9 is a perspective view of the back of a universal inside corner patch showing a backing sheet being peeled away from a self-adhesive backing according to one embodiment of the invention.

FIG. 9 illustrates one embodiment of the inside corner patch of this disclosure that includes a self-adhering feature to hold the corner patch in its folded configuration and adhere the corner patch in place in a corner. The corner patch 61 comprises a body 62 with a cutout 63 as described in detail above. The back surface of the body 62 is coated with a self-adhering coating 66 that may be covered with a peel-away protective release layer 64. The adhesive can be in the form of a tape or a hot melt adhesive made with greater than about 50% butyl polymer or a blend of butyl polymers and Styrene copolymers such as butadiene Styrene (SBS), Styrene ethylene butylenes Styrene (SEBS), Styrene ethylene-propylene (SEP), or Styrene ethylene-propylene Styrene (SEPS). The adhesive may further comprise less than about 30% of a aliphatic or aromatic hydrocarbon tackifier resin, less than about 10% fillers such as clay, talc, CaCO3, MgO, Mg(OH)2, less than about 5% thermal stabilizers, antioxidants, and processing aids. A functional coating hot melt adhesive that meets the AFERA 5001 standard is one example of an appropriate adhesive for use in the present invention. The thickness of the adhesive coating may be in the range of from 5 to 40 mils and preferably from 10 to 20 mils. The adhesive can be reinforced with an appropriate material such as a thin porous laid polyester fiber mat having a preferred thickness less than 15 mils to add strength.

To fold and then apply the corner patch of FIG. 9, the release layer 64 is peeled away and the patch body 62 is folded as described above to match the angle of the inside corner to be sealed. When so folded, the flap portion 18 (FIG. 2) adheres to the now exposed adhesive on the back of the skirt portion to hold the patch in its folded configuration. The patch can then be applied to an inside corner defined in a roof and pressed to adhere the patch in place. Heat may be applied if desired to seal the patch further in the corner by liquefying the hot melt adhesive so that it bonds to the surfaces that meet at the inside corner.

The invention has been described herein in terms of preferred embodiments and methodologies considered by the inventors to represent the best mode of carrying out the invention. It will be understood by the skilled artisan; however, that a wide range of additions, deletions, and modifications, both subtle and gross, may be made to the illustrated and exemplary embodiments without departing from the spirit and scope of the invention. For instance, while several different materials have been mentioned as roofing membrane materials, the term "membrane" should be construed as including any web material that may be used to seal the roof of a commercial or residential building where corners are encountered and need to be sealed. The inside corner patches in the illustrated embodiments are generally circular. However, other shapes such as, for instance, square, rectangular, oval-shaped, and others may be substituted within the scope of the invention. Pie-shaped cutouts have been illustrated and described above; however, this is not a limitation of the invention and cutouts of other shapes such as curved, for example, may be used.

The corner patches have been described with fold lines corresponding to specific angles such as 80 degrees or 110 degrees. These angles are shown and described for clarity of explanation, but do not represent limitations of the invention. In fact, the corner patches of this invention may accommodate obtuse and acute angled inside corners of virtually any angle within the physical restraints of the material from which the patch is made and its geometry. The patch may be placed in a corner of unknown angle, for example, and massaged and shaped in place to conform itself to the corner without the installer ever actually measuring or knowing the angle of the corner. These and other modifications and substitutions may suggest themselves to persons of ordinary skill in the art and such should be construed to be within the scope of the invention disclosed herein.

What is claimed is:

1. A universal inside corner patch made from a single piece of membrane material, the corner patch comprising:

a body having a center portion and a perimeter;

an angular cutout in the body extending from a first relatively wider end at the perimeter of the body to a second relatively narrower end adjacent the center portion of the body, the second relatively narrower end being located closer to the center portion of the body than to the perimeter of the body;

a relief cut extending from the center portion of the body to the second relatively narrower end of the angular cutout;

the angular cutout and the relief cut forming in the body a skirt portion having an edge on one side of the angular cutout and a flap portion on an opposite side of the angular cutout, the skirt portion and the flap portion being spaced from each other when the patch is in a flat configuration;

a first set of fold lines on the body along which the body can be folded;

a second set of fold lines on the body, the second set of fold lines including a plurality of optional fold lines each corresponding to an angle of an inside corner to be patched;

the corner patch conforming to the shape of an angled inside corner when the corner patch is folded along the first set of fold lines and along a selected one of the second set of fold lines and the skirt portion is overlapped with the flap portion such that the edge of the skirt portion aligns with the selected one of the second set of fold lines.

2. The universal inside corner patch as claimed in claim 1 wherein the body has a front surface and a back surface and further comprising an adhesive on the back surface of the body.

3. The universal inside corner patch as claimed in claim 2 further comprising a release layer covering the adhesive.

4. The universal inside corner patch as claimed in claim 1 wherein the patch has a flexural modulus of 1,500 psi to 20,000 psi.

5. The universal inside corner patch as claimed in claim 1 wherein the patch is heat weldable to a roof membrane.

6. The universal inside corner patch as claimed in claim 1 wherein the body is substantially round in shape.

7. The universal inside corner patch as claimed in claim 6 wherein the first set of fold lines divides the body into quadrants and wherein the cutout is formed in a selected one of the quadrants.

8. The universal inside corner patch as claimed in claim 7 and wherein the second set of fold lines are clustered about one of the first set of fold lines at an edge of the selected one of the quadrants.

9. The universal inside corner patch as claimed in claim 8 wherein at least one of the second set of fold lines is to one side of the one of the first set of fold lines and at least one of the second set of fold lines is to the opposite side of the one of the first set of fold lines.

10. The universal inside corner patch as claimed in claim 1 wherein the first set of fold lines are mutually orthogonal.

11. The universal inside corner patch as claimed in claim 1 wherein the body is made of a thermoplastic material.

12. The universal inside corner patch as claimed in claim 11 wherein the thermoplastic material is selected from the group consisting essentially of PVC, PVC, TPA, TPO, CPE, and EPDM.

13. An inside corner patch selectively configurable to conform to the shape of an inside corner defined by a deck, a first wall projecting upwardly from the deck at a first angle, and a second wall projecting upwardly from the deck at a second angle, the corner patch being formed of a single piece of membrane material and comprising a body having a perimeter and a center portion, a cutout in the body extending from a first relatively wider end at the perimeter of the body to a second relatively narrower end adjacent the center portion of the body, the second relatively narrower end of the cutout being located closer to the center portion of the body than to the perimeter of the body, and a relief cut shorter than the cutout and extending from the center portion of the body to the second relatively narrower end of the cutout, the cutout defining a first portion of the body on one side of the cutout and a second portion of the body spaced from the first portion of the body on the other side of the cutout, the patch conforming in shape to the shape of the inside corner when the first and second portions of the body are mutually overlapped by a selected amount corresponding to the first and second angles.

14. The inside corner patch as claimed in claim 13 wherein the first angle is a right angle and the second angle is an obtuse angle.

15. The inside corner patch as claimed in claim 13 wherein the first angle is a right angle and the second angle is an acute angle.

16. The inside corner patch as claimed in claim 13 further comprising a first set of fold lines extending from the perimeter of the body to the center portion and dividing the body into four portions, the cutout being formed in a selected one of the four portions.

17. The inside corner patch as claimed in claim 16 further comprising a second set of fold lines clustered about one of the fold lines that boarders the selected one of the four portions, each of the second set of fold lines indicating an amount of overlap of the first and second portions of the body corresponding to a corresponding second angle.

18. The inside corner patch as claimed in claim 13 wherein the body is disc-shaped.

19. An inside corner patch made from a single piece of thermoplastic material and comprising a body having a perimeter and a center, a pie-shaped cutout in the body extending for a first distance and at an angle from a first relatively wider end at the perimeter to a second relatively narrower end adjacent the center, the cutout defining a flap on one side of the cutout and a skirt spaced from the flap and extending at an angle relative to the flap on the other side of the cutout, and an array of spaced indicia on one side of the cutout, the body conforming to the shape of a selected inside corner when the skirt and the flap are mutually overlapped such that an edge of the cutout aligns with one of the indicia that corresponds to the shape of the selected inside corner.

20. The inside corner patch as claimed in claim 19 wherein the spaced indicia comprise an array of fold lines extending from the perimeter of the body to the center of the body.

21. The inside corner patch as claimed in claim 19 further comprising a relief cut in the body extending from the center to the second relatively narrower end of the cutout and extending for a distance shorter than the first distance, the relief cut bordering and at least partially forming the flap.

* * * * *